US005210965A

United States Patent [19]

Funk, Sr. et al.

[11] Patent Number: 5,210,965

[45] Date of Patent: May 18, 1993

[54] FABRICATED BUCKET TOOTH

[75] Inventors: Charles F. Funk, Sr.; Charles F. Funk, Jr., both of Gulfport, Miss.

[73] Assignee: Metal Parts, Inc., Gulfport, Miss.

[21] Appl. No.: 469,036

[22] Filed: Jan. 23, 1990

[51] Int. Cl.[5] ..... E02F 9/28

[52] U.S. Cl. ..... 37/454; 37/460; 37/398; 172/713; 172/719

[58] Field of Search ..... 37/141 T, 142 R, 115, 37/141 R, 142 A; 299/79, 88; 172/713, 719

[56] References Cited

U.S. PATENT DOCUMENTS

| | | | |
|---|---|---|---|
| 1,778,213 | 10/1930 | Fahrenwald | 37/142 R |
| 3,864,853 | 2/1975 | Klett et al. | 37/141 T |
| 4,277,106 | 7/1981 | Sahley | 299/79 |
| 4,326,348 | 4/1982 | Emrich | 172/719 X |
| 4,428,131 | 1/1984 | Hahn | 172/713 X |

FOREIGN PATENT DOCUMENTS

| | | | |
|---|---|---|---|
| 623958 | 9/1978 | U.S.S.R. | 299/79 |
| 714003 | 2/1980 | U.S.S.R. | 37/142 R |
| 891870 | 2/1981 | U.S.S.R. | 37/142 R |
| 1157185 | 5/1985 | U.S.S.R. | 37/142 R |
| 1263837 | 10/1986 | U.S.S.R. | 299/79 |
| 2093325 | 9/1982 | United Kingdom | 172/719 |

OTHER PUBLICATIONS

"Powder Metallurgy Materials", *Metals Handbook*, American Society for Metals, 1985, pp. 19-2-3.

*Primary Examiner*—Randolph A. Reese
*Assistant Examiner*—Arlen L. Olsen
*Attorney, Agent, or Firm*—Vaden, Eickenroht, Thompson, Boulware & Feather

[57] ABSTRACT

A replaceable point is disclosed for attaching to the nose of an adapter to provide a tooth for an earth digging and moving bucket. The point is made up of a plurality of flat-sided, rolled steel plates that are held in aligned side-by-side relationship. The plates have edges that are contoured to form a point of the desired shape.

5 Claims, 2 Drawing Sheets

FIG. 3
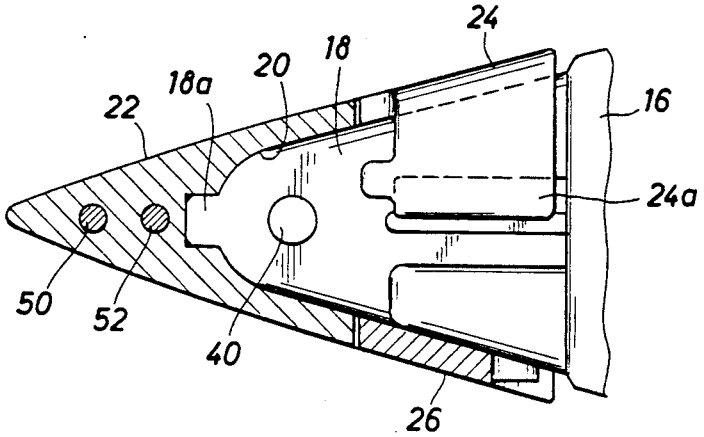
FIG. 4
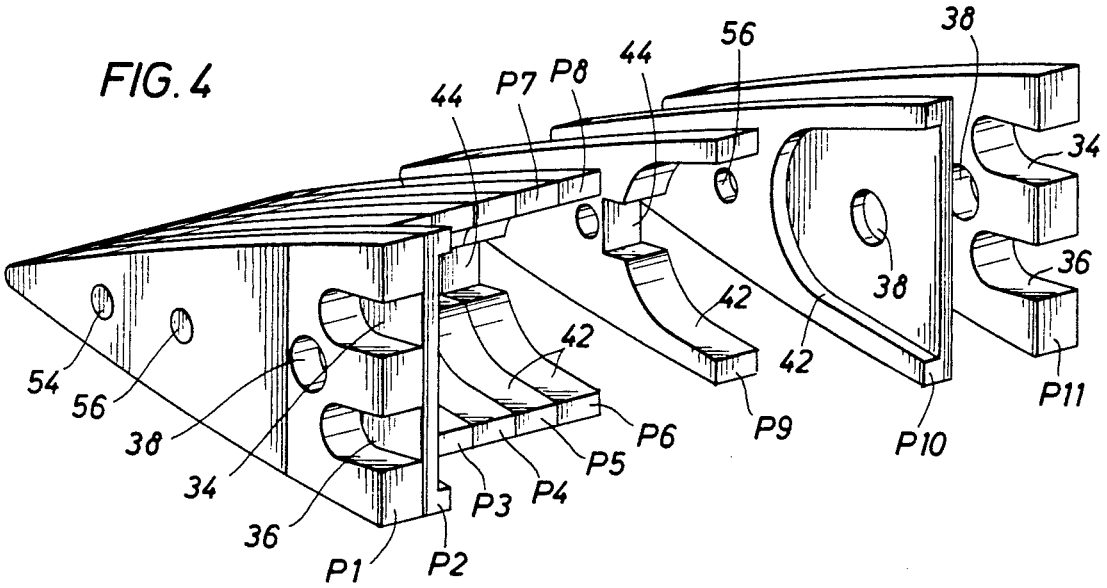
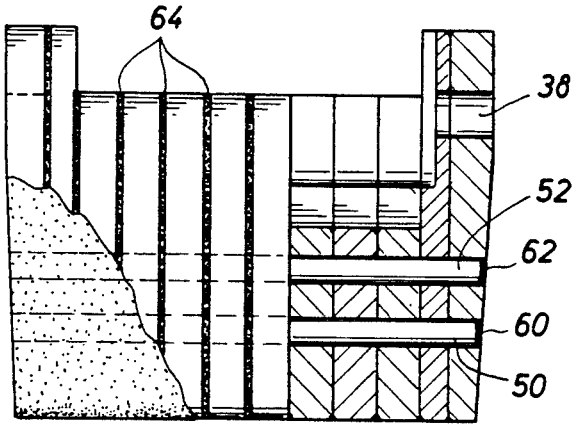
FIG. 5

FABRICATED BUCKET TOOTH

BACKGROUND OF THE INVENTION

This invention relates to bucket teeth generally and in particular to a replaceable point for such teeth.

Earth digging and moving equipment such as shovels, drag lines, trenchers, backhoes, and loaders all use bucket-shaped containers to dig and move dirt, ore, and the like. These buckets have front lips that have teeth spaced along and attached to the lips. These teeth are subjected to the erosive effect of the materials being dug or moved and, depending upon the material, have a relatively short life. As a consequence, present-day teeth are made up of several different parts. First, there is an adapter that is attached to the lip of the bucket. The adapter includes a nose that is shaped to fit a cavity in a replaceable point that is attached to the adapter. The point is generally wedge-shaped and provides the relatively sharp forward end of the tooth. Usually, the exposed part of the adapter is covered by wear caps so that the adapter is protected from the abrasive effects of the material being handled. The point and wear caps are replaceable and they are expected to take the wear.

Tooth points are presently and have always been made of cast steel. Cast metal is inherently brittle and is subject to failure from impact loading. Castings often contain hidden flaws that can cause premature failure. With the alloys presently used to cast tooth points, welding on the points is not recommended. Consequently, they cannot be hard-surfaced with tungsten carbide and the like to improve the wear resistance of the point.

It is an object of this invention to provide a point for an earth digging and moving bucket tooth that is made of rolled steel and therefore has the strength and wear resistance of any of the available steels on the market. Such a tooth point can then be provided with selected hard facing that will greatly increase the ability of the tooth to resist wear and thereby extend the life of the tooth point.

It is a further object and advantage of this invention to provide an all steel replaceable point for connecting to an adapter to form a bucket tooth for an earth digging and moving bucket that includes a plurality of flat-sided rolled steel plates that are arranged in side-by-side alignment with the contour of the end walls of the plates forming the shape of a tooth point.

These and other objects, advantages, and features of this invention will be apparent to those skilled in the art from a consideration of this specification including the attached drawings and appended claims.

BRIEF DESCRIPTION OF THE DRAWINGS

In the drawings:

FIG. 3 is a view partly in section and partly in elevation through the tooth of FIG. 2;

FIG. 4 is an exploded view of the arrangement of the plates that make up the tooth point of this invention; and FIG. 5 is a top view of the point of this invention, partly in section and partly in elevation.

DETAILED DESCRIPTION OF THE PREFERRED EMBODIMENT

Figure 1:
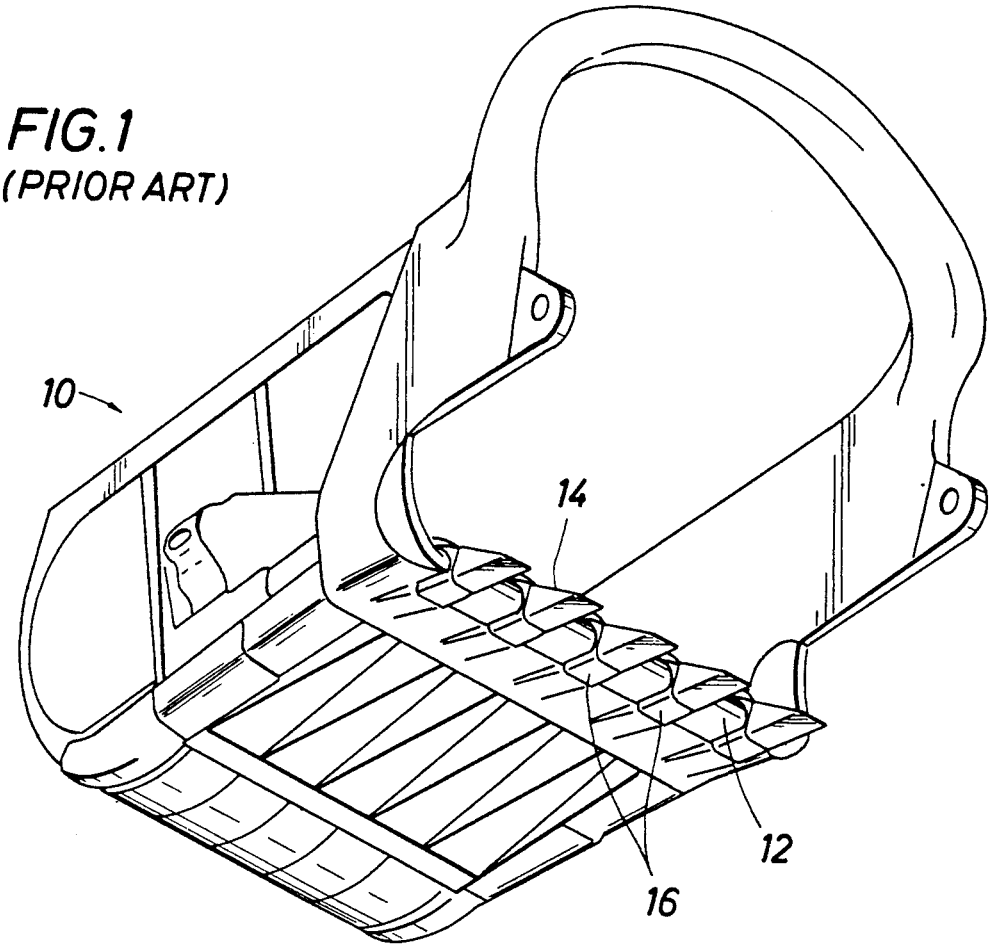
FIG. 1 (PRIOR ART)
FIG. 1 is an isometric view of a typical bucket.

The bucket shown in FIG. 1 is of the type usually used with drag lines. The shape of the bucket varies with the particular piece of equipment with which it is to be used. For example, there are trencher buckets, backhoe buckets, loader buckets, and shovel dipper buckets. All of these buckets have one thing in common—they have a capacity to hold a given amount of dirt and they have a plurality of teeth that will dig into the ground and break loose the dirt that fills the bucket.

In FIG. 1, for example, bucket 10 has lip 12 to which are attached a plurality of spaced teeth 14. Five teeth are shown in the drawing. At one time, bucket teeth were probably of unitary construction, but they have evolved today into an assembly of parts. The parts include adapter 16 that is attached to the lip of the bucket. The adapter has nose section 18 shaped to fit in mating cavity 20 of point 22, as shown in FIG. 3. Wear caps 24 and 26 are attached on the top and bottom of the adapter to protect the adapter from the abrasive action of the materials through which the tooth assembly is moved in operation. In this way the adapter will show very little wear and the only things that need to be replaced from time to time are the wear pads and the point.

Figure 2:
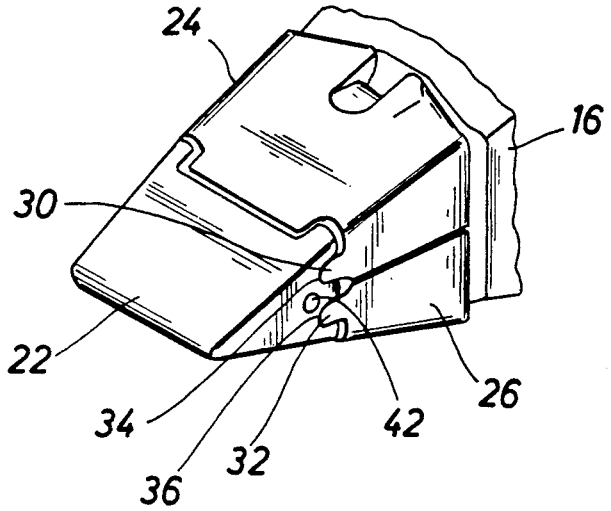
FIG. 2 (PRIOR ART)
FIG. 2 is an isometric view of an assembled bucket tooth that includes the point, the adapter, and the wear plates or caps to protect the adapter.

The tooth is assembled in the following manner. Wear pads 24 and 26 are installed on the adapter first, since they have inwardly extending ribs, such as rib **24*a* shown in dotted lines in FIG. 3, that slide in slots in the side of the adapter so that, when in the position shown in FIG. 3, the wear pads are held against upward movement away from the nose of the adapter. The front end of each wear pad is provided with a finger on each side, such as finger 30 on wear pad 24 and finger 32 on wear pad 26. The fingers on the other side are not shown. Each side of point 22 is provided with grooves 34 and 36 that will engage fingers 30 and 32 and the fingers on the other side when the point is attached to the adapter in the manner shown in FIG. 2. This keeps the wear pads from moving forward and out of engagement with the slots of the adapter. Thus, the whole assembly is locked together when point 22 is attached to the adapter by pin 42 extending through opening 38 in the point and opening 40** in the adapter. Alternatively, two short pins can be used, one on each side, since this makes it easier to remove the pins.

The point section of the finger, in accordance with this invention consists of a plurality of flat-sided, rolled steel plates. By rolled steel, it is meant steel made in the conventional manner, open hearth, electric furnace, etc. and either hot or cold rolled into plates. The plates, P1 through P11 (twelve plates are shown in FIG. 5) have their end walls or edges contoured to form the outer and inner surface of point 22. Plates P1 and P11, for example, provide grooves 34 and 36 on opposite sides of the point. The other plates provide inner curved surfaces 42 that combine to form cavity 20 to mate with the curved portion of nose 18. Plates P3–P9 have flat sided grooves 44 that engage flat side portion **18*a* of nose 18**.

The plates are held in side-by-side relationship by elongated pins 50 and 52 that extend through openings 54 and 56 in the plates. The pins are designed to be a little short so they can be welded to the outside plates by welds 60 and 62 as shown in FIG. 5.

Although pins 50 and 52 will hold the plates assembled, it is preferred to also weld the plates together by welds 64 that extend completely around the circumference of the plates and attach each plate to the plates adjacent to it.

To further extend the life of the tooth point, hard facing 66 can be applied over the entire surface of the point or over selected portions. For example, spaced, parallel strips of hard facing material, such as tungsten carbide can be used.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A replaceable point having a cavity to receive a nose of an adapter to provide a tooth for an earth digging and moving bucket comprising a plurality of flat-said, rolled steel plates, said plates being generally triangular shaped having an apex and a base opposite the apex, means for holding the plates in vertical, side-by-side relationship with the apexes of the plates aligned to form a cuting edge and the bases having recesses therein that combine to form a cavity to receive the nose of the adapter.

2. The replaceable point o claim 1 further provided with aligned holes in each plate and a rod extending through the holes and welded to the outermost plates.

3. The replaceable point of claim 1 further provided with two aligned holes in each member and rods extending through the aligned holes and welded to the outermost plates.

4. The replaceable point of claim 1, 2 or 3 further provided with strips of tungsten carbide extending laterally across the adjacent edges of the plates.

5. A replaceable point having a cavity to receive a nose of an adapter to provide a tooth for an earth digging and moving bucket comprising a plurality of flat-sided, steel plates, said plates being generally triangular shaped having an apex and a base opposite the apex, weldments between the plates for holding the plates in vertical, aligned, side-by-side monolithic relationship with the apexes of the plates aligned to form a cutting edge and the bases having recesses therein that combine to from a cavity to receive the nose of the adapter and means for attaching the point to the adapter.

* * * * *